United States Patent [19]

Velke, Sr. et al.

[11] Patent Number: 4,944,699

[45] Date of Patent: Jul. 31, 1990

[54] SPLICING CONNECTOR

[76] Inventors: David C. Velke, Sr., 3305 Aldie Rd., Catharpin, Va. 22018; George P. Marsden, 7621 Mary Cassatt Dr., Potomac, Md. 20854; Burton C. Leffingwell, 242 Meadows La., N.E., Leesburg, Va. 22075

[21] Appl. No.: 372,657

[22] Filed: Jun. 28, 1989

[51] Int. Cl.[5] ..... H01R 4/30

[52] U.S. Cl. ..... 439/784; 174/84 S; 403/314

[58] Field of Search ..... 174/845; 439/784, 807, 439/801, 783, 723, 724, 791, 794, 805; 403/286, 287, 305, 314; 24/122.6, 136 L, 136 B

[56] References Cited

U.S. PATENT DOCUMENTS 329,162 10/1885 Hamilton ..... 403/314

3,810,078 5/1974 Chordas ..... 439/784

FOREIGN PATENT DOCUMENTS 496571 12/1955 Italy ..... 439/805

*Primary Examiner*—Gary F. Paumen

*Attorney, Agent, or Firm*—Richard C. Litman

[57] ABSTRACT

A splicing device to join the free ends of two cables. The present invention provides a non-conductive housing assembly around a possibility of three inner conductive connector means. The inner conductive connector means joins the free ends of a conductive cables such that there is an uninterrupted electrical flow path between the ends of the cables. The connector housing provides a protective outer housing around the assembly and holds the spliced ends of the cables together. The splicing device can be readily installed to provide a safe and reliable splicing of free cable ends.

2 Claims, 2 Drawing Sheets

10
11a
21
11
14
S
40a
13
30
W
15
S
14
40
20
12
30
W 11a
21
11
14
41a
13
30
W
16c
16a
16
16b
14
41
20
12
30
W

SPLICING CONNECTOR

BACKGROUND OF THE INVENTION

1. Field of the Invention

The present invention relates to devices for splicing or connecting the two free ends of electrical cables or the like. More specifically, the present invention offers a means to connect the spliced ends of a cable and to assure a sufficiently good and continuous contact to provide uninterrupted electrical service. The present invention provides a connector housing into which the free ends of the cable are threadably fastened. The present invention provides three alternate means for connecting the spliced cable end together. All three designs offer an outer connection housing within which a conductive camming or crimping element is located to facilitate connection of the cable ends.

2. Description of the Prior Art

The present invention is specifically designed to incorporate both a simple and useful connection means to mechanically and electrically splice the free ends of cable conductors together. Though a new and unique method is presented herein, the concept of providing cable connectors is a well-founded art.

U.S. Pat. No. 3,980,806 issued to Francis A. May on Sept. 14, 1978 discloses a cable splicing or connection means for joining the free ends of a flexible conducting cable. The free cable ends are affixed via a deformable metallic annular element and then surrounded by an insulating material. The entire arrangement is encapsulated in a flexible metallic sleeve to protect the connection.

U.S. Pat. No. 2,058,929 issued to E. R. Vietzen on Dec. 8, 1936 discloses a cable splice connector that is substantially an annular member juxtaposed between the ends of an electrical cable. The annular region is fixed in place by a tape wrapping around both the device and the exposed wire ends.

Though these methods of connecting a electrical cables together are functional, they do not offer the versatibilty nor the functionality of the present invention. There exist a number of deficiencies in the art of connecting the ends of electrical cables together. Primarily, there is a need for an apparatus that can be quickly and readily installed.

As indicated by the prior art, the primary methods for splicing cable together require that the individual compress members together to assure a fixed connection. Also, the individual may need to tape the connected wires to one another to assure an insulated connection that will not be conducive to hazard. These methods are time comsuming. It would be far better if the protective sheath were able both to reduce the possibility of electrical hazard and to provide a reliable connection of the ends of spliced cable.

A further concern in this area is the provision of a flexible housing that can be wound onto a spool. This is a particular concern in the mining industry where cables and wires are laid, wound, and laid again. The major concern is that the connective element be non-abrading. Such a connection prevents the inadvertent cutting of cable that comes into contact with the splice element.

The present invention offers a non-conductive housing wherein a conductive element is placed to connect the free ends of the cables. The housing can be sealed by screwing an end cap in place, thereby providing a reliable connection. The sealed housing prevents the weathering of the wires and corrodible elements within it. Additionally, the present invention offers a means to assure that there will be a complete and lasting connection of the ends of spliced wire. The housing may be composed of a flexible substance, thereby providing a suitable means to connect wire that must be wound onto a spool.

The present invention offers a simple and effective means for joining the spliced ends of a cable in a safe and efficient manner. Moreover, due to the relative simplicity of the present invention, the cable connector can be installed rapidly yet maintain the effectiveness of the connection.

SUMMARY OF THE INVENTION

Accordingly, it is an object of the present invention to provide a splice connector having an outer non-conductive housing and inner conductive connection element for joining the free ends of cables in a safe and effective manner.

It is a further object of the present invention to provide a means for the connection of the free ends of a cable such that the end cannot be inadvertently removed from one another once so attached.

It is still another object of the present invention to provide a means of connecting the free ends of cables so that there exists a reliable connection of the cable ends. This ensures that the flow of electrical energy is not interrupted at any point in the splice connection.

It is still another object of the present invention to provide a splicing means that is simple to install and can be installed in a short period of time.

It is yet another object of the present invention to provide a housing that can be manufactured from a flexible material to allow spooling of the wire. The flexible housing both allows for arcuate displacement of the housing as well as preventing the inadvertent splicing of wires in the vicinity of the splicing means.

With these and other objects in view which will more readily appear as the nature of the invention is better understood, the invention resides in the novel combination and arrangement of parts hereinafter more fully described and illustrated, with reference being made to the accompanying drawings.

BRIEF DESCRIPTION OF THE DRAWINGS

Similar reference characters designate corresponding parts throughout the various figures of the drawings.

DESCRIPTION OF THE PREFERRED EMBODIMENT

Figure 1:
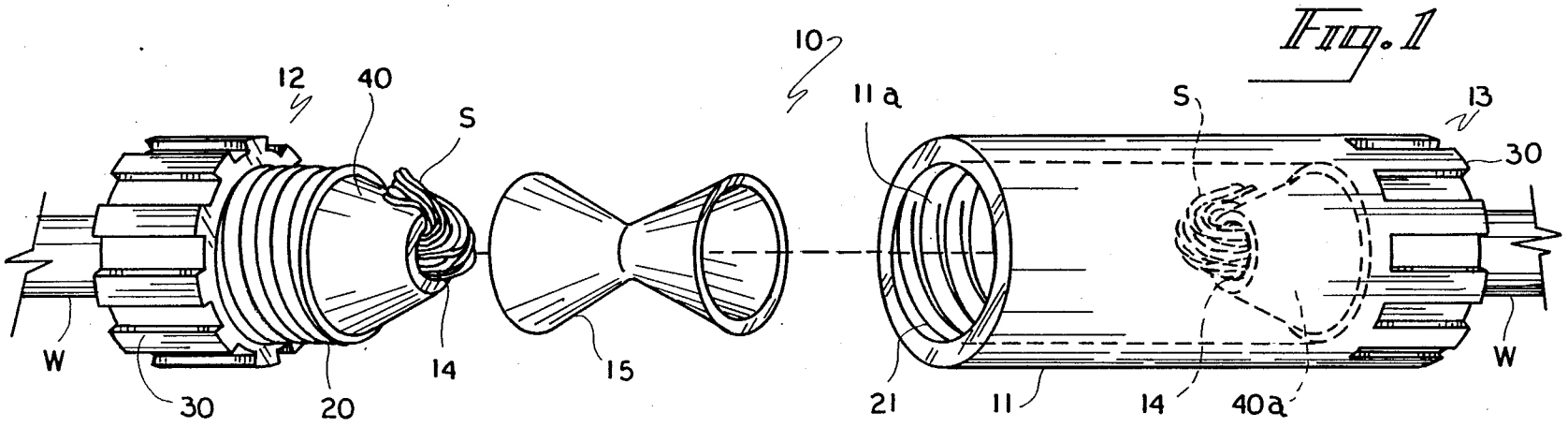
FIG. 1 is a perspective illustration of the connector housing in an exploded view. Also shown is the first version of the inner conductive element.

The splicing connector is generally designated 10 in FIG. 1. The splicing connector 10 has one of three possible alternative embodiments which are herein described and claimed. The splicing connector 10 is generally composed of a connector housing 11 which is essentially a hollow cylindrical construction. The open ends of the connector housing 11 are closed by the threaded placement of a removable lateral end cap 12 and a fixed end cap 13.

Figure 2:
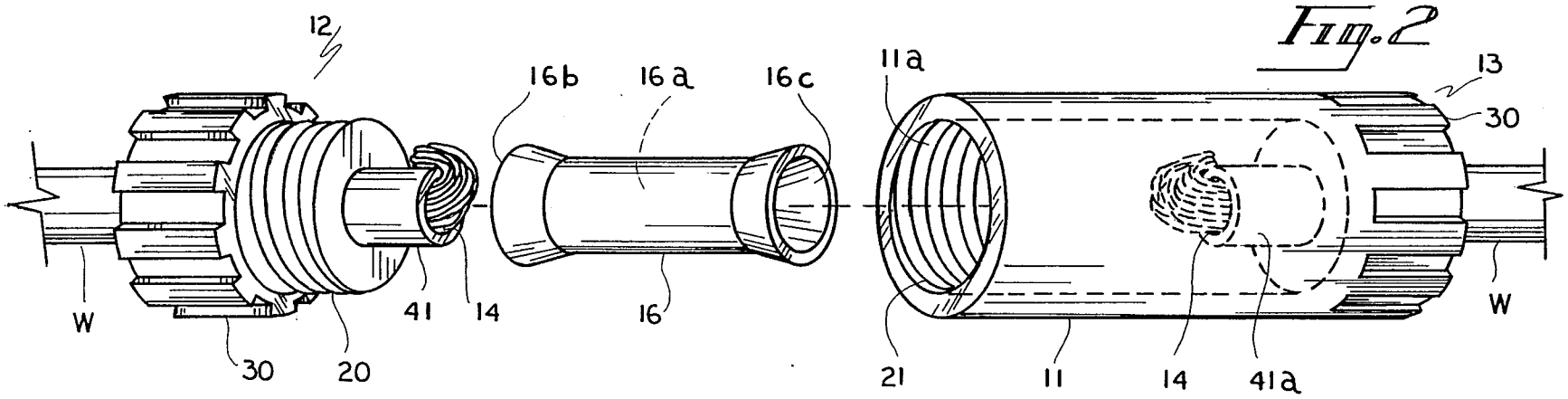
FIG. 2 is an exploded perspective illustration of the second type of conductive element. This element is to be located within the connector housing as depicted in FIG. 1.
Figure 3:
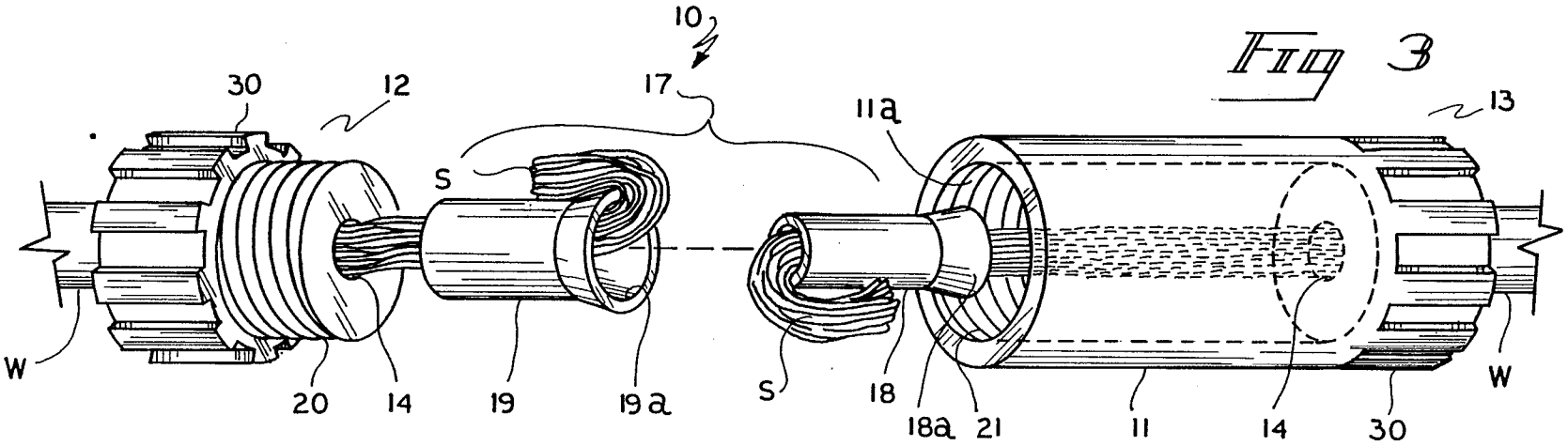
FIG. 3 is an exploded perspective illustration of the third type of conductive element provided by the present invention. This element is also to be located within the connector housing depicted in FIG. 1.

The lateral end cap and fixed end cap 12 and 13 are essentially hollow cylindrical constructions. They are each provided with a wire hole 14 through their center portions through which a wire W or free cable end is threaded. Between the two end caps 12 and 13 and within the connector housing interior chamber 11*a*, there is a separate insertable conductive connector. Each embodiment is equipped with a conductive connector of a different shape. In FIG. 1, FIG. 2, and FIG. 3, the conductive connector is designated 15, 16, and 17, respectively.

The lateral end cap 12 contains threaded grooves 20 around its inner end. These threaded grooves 20 are such that they engage with cooperating threaded grooves 21 on the interior surface of the connector housing 11. The grooves 21 located on the interior portion of the connector housing 11 are located at the inner end of the connector housing 11 on the interior surface. The other outer end of both the lateral end cap 12 as well as the fixed end cap 13 are provided with longitudinal gripping tracks 30. These tracks 30 allow the person installing the connector 10 to grasp the lateral end cap 12 and fixed end cap 13, and screw them securely together. The fixed end cap 13 is then fixedly attached to the housing 11.

The lateral end cap 12, the fixed end cap 13, and the connector housing 11 should be constructed of a non-conductive material such as plastic or hard rubber. This will prevent the build-up of an electrical charge on the surface of the connector housing 11 and prevent any shock to a person handling a cable so equipped. It should be noted at this point, however, that the connector housing 11 need not be constructed solely of plastic. Any non-conducting material or combination of such is suitable for this application as long as it provides a sufficiently strong construction. In fact, the materials may be chosen depending upon the particular application. The material should be chosen such that it is semi-flexible when molded into the appropriate shape. This will aid in the spooling of a wire W with the splicing connector 10 and prevent splicing of the wire by the splicing connector 10.

Figure 4:
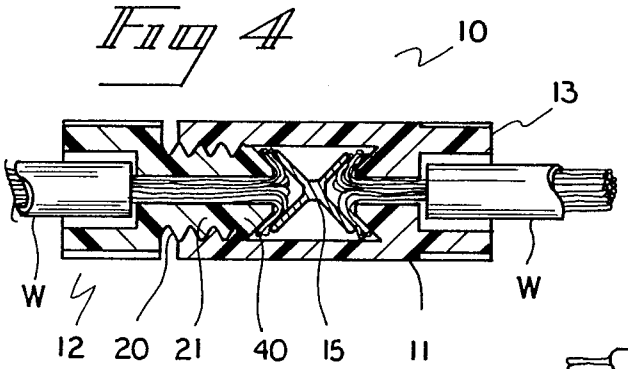
FIG. 4 is a cross-sectional illustration of the splice connector assembly shown in FIG. 1.

In FIG. 1, the conductive connector 15 has a double conical shape. More specifically, the conductive connector 15 is shaped like two conical members attached at their respective points such that adjacent conical or frusto-conical cavities 15*a*, 15*b* are provided. The lateral end cap 12 and the fixed end cap 13 will be seen to include opposed, conically-shaped, apertured formations or protrusions 40, 40*a*, respectively and which face the interior chamber 11*a* of the connector housing 11. Thus when two wires W are stripped and the exposed strands S inserted through the cap holes 14, a positive mechanical and electrical bond will be achieved when the lateral end cap 12 is threadedly affixed to the housing 11. From the assembled view of FIG. 4 it will be seen that as the lateral end cap 12 is tightened, the plurality of flexible wire strands S will become captured within the cavities 15*a*, 15*b* and firmly crimped between the nested conical surfaces.

Figure 5:
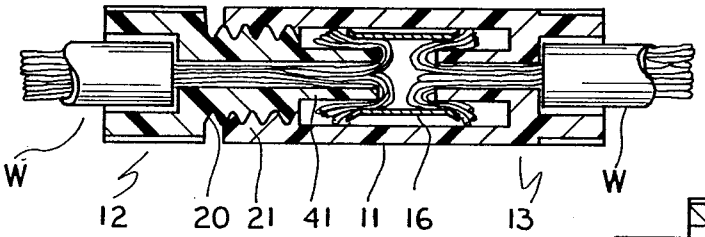
FIG. 5 is a cross-sectional illustration of the splice connector assembly depicted in FIG. 2.

FIG. 2 shows a slightly different version of the conductive connector 16. In this embodiment, the conductive connector 16 is essentially a cylindrical element having conically shaped flanges on either end and includes a central, axially extending bore 16*a* bounded by frustro-conical cavities 16*b*, 16*c*. The end caps, 12' and 13', are also slightly altered from the previous embodiment. In this case, the end caps, 12' and 13', have cylindrical apertured protrusions 41, 41*a* extending from the surface which faces the interior chamber 11*a* of the connector housing 11. Thus, when wire strands S are threaded through the two opposed wire holes 14, 14 of the cylindrical protrusions 41, 41*a*, they are folded back along the length of the cylindrical protrusions as shown in FIG. 5 as the components are assembled. It will be noted that the conductive connector 16 slides over both the cylindrical protrusions 41, 41*a* to capture and crimp the wire strands S therebetween. Since it provides a snug fit, the conductive connector 16 will contact at least a segment of the exposed wire W. As a result, there will always be a secure connection between the ends of the spliced wires W.

In FIG. 3, a slightly different approach is taken to the conductive connector 17. Here, the conductive connector 17 is divided into two segments, the inner conductive element 18 and the outer conductive element 19. Each of the two elements, 18 and 19, are essentially cylindrical in shape with a conically shaped flange 18*a*, 19*a* at one end respectively. However, the outer conductive element 19 has a slightly larger diameter than the inner conductive element 18.

Figure 6:
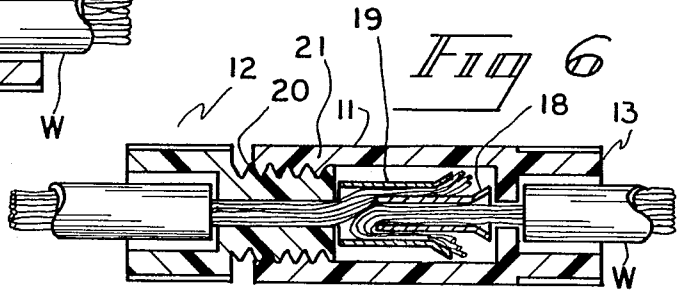
FIG. 6 is a cross-sectional illustration of the splice connector assembly shown in FIG. 3.

In this embodiment, the end caps, 12 and 13, have planar surfaces on the ends which face the interior 11*a* of the connector housing 11. The wires W are threaded through the end caps 12 and 13, and then through the respective two parts of the conductive connector 17. At one end of the splicing connector 10, the wire W is threaded through the flange end of the inner conductive element 18 while at the other end, the wire W is threaded through the non-flange end of the outer conductive element 19. The wires W are folded back upon the conductive elements, 18 and 19. When the outer conductive element 19 is pressed over the inner conductive element 18, as shown in FIG. 6, a strong and reliable connection is formed between the spliced strands S of the two wires W.

Thus, in these three alternate fashions, the splicing connection is created. The conductive connectors, 15, 16, and 17, each function to provide a reliable connection between the exposed ends S of the spliced wire W. The non-conductive housing 11 provides the necessary sheath to the connection. The non-conductive housing 11 prevents the buildup of charge on its exterior surface, therefore, it prevents inadvertent shock from the wires W therein contained.

It is to be understood that the present invention is not limited to the sole embodiment described above, but encompasses any and all embodiments within the scope of the following claims.

We claim:

1. A connector means for the joining of the free ends of separate wire cables, comprising:

a connector housing having an outer and inner surface, said connector housing having two opposite ends, threaded fastener means on one said connector housing end, said connector housing being substantially hollow throughout its length and defining an interior chamber therein, a lateral end cap removably attachable to said connector housing by said threaded fastener means, said connector housing having a fixed housing end cap at its end opposite said end having said threaded fastener means, said removable lateral end cap and said fixed housing end cap each having a passageway therethrough for receiving the free end of the wire cable, said removable lateral end cap and said fixed housing end cap each having a cylindrical portion disposed thereon with said removable lateral end cap cylindrical portion insertable within said connector housing interior, a separate conductive connector member insertable within said connector housing interior, said conductive connector member having a cylindrical shape and provided with conically shaped flanges at either end thereof, and said cylindrical portions respectively insertable within said conically shaped flanges at either end of said conductive connector member, whereby upon insertion of wire cable ends through said lateral end cap and connector housing end cap passageways and movement of said lateral end cap toward said connector housing, the wire cable ends are captively secured between said conductive connector member flanges and said respective cylindrical portions.

2. A connector means for the joining of the free ends of separate wire cables, comprising:

a connector housing having an outer and inner surface, said connector housing having two opposite ends, threaded fastener means on one said connector housing end, said connector housing being substantially hollow throughout its length and defining an interior chamber therein, a lateral end cap removably attachable to said connector housing by said threaded fastener means, said connector housing having a fixed housing end cap at its end opposite said end having said threaded fastener means, said removable lateral end cap and said fixed housing end cap each having a passageway therethrough for receiving the free end of a wire cable, said removable lateral end cap and said fixed housing end cap each having a projecting portion axially extending therefrom with said removable lateral end cap projecting portion insertable within said connector housing interior, said projecting portions defining a circular configuration in transverse cross-section, a separate conductive connector member insertable within said connector housing interior, said conductive connector member having a circular shape in transverse cross-section and provided with conically shaped flanges at either end thereof, and said projecting portions respectively insertable within said conically shaped flanges at either end of said conductive connector member, whereby upon insertion of wire cable ends through said lateral end cap and connector housing end cap passageways and movement of said lateral end cap toward said connector housing, the wire cable ends are captively secured between said conductive connector member flanges and said respective projecting portions.

* * * * *